US008939078B2

(12) United States Patent
Kamoda et al.

(10) Patent No.: US 8,939,078 B2
(45) Date of Patent: Jan. 27, 2015

(54) INK SUPPLY APPARATUS OF PRINTING PRESS

(75) Inventors: Hiroyoshi Kamoda, Ibaraki (JP); Akehiro Kusaka, Ibaraki (JP); Hiroto Nagura, Ibaraki (JP); Norihiro Kumagai, Ibaraki (JP); Hiroyuki Sato, Ibaraki (JP); Akihiko Takenouchi, Ibaraki (JP)

(73) Assignee: Komori Corporation, Tokyo (JP)

( * ) Notice: Subject to any disclaimer, the term of this patent is extended or adjusted under 35 U.S.C. 154(b) by 152 days.

(21) Appl. No.: 13/571,322

(22) Filed: Aug. 9, 2012

(65) Prior Publication Data

US 2013/0042777 A1 Feb. 21, 2013

(30) Foreign Application Priority Data

| | | |
|---|---|---|
| Aug. 17, 2011 | (JP) | 178219/2011 |
| Aug. 17, 2011 | (JP) | 178222/2011 |
| Aug. 17, 2011 | (JP) | 178281/2011 |
| Aug. 17, 2011 | (JP) | 178282/2011 |
| Aug. 17, 2011 | (JP) | 178285/2011 |

(51) Int. Cl.

| | |
|---|---|
| ***B41F 31/02*** | (2006.01) |
| ***B41F 9/10*** | (2006.01) |
| ***B41F 9/06*** | (2006.01) |
| ***B41F 33/02*** | (2006.01) |
| ***B41F 35/04*** | (2006.01) |

(52) U.S. Cl.

CPC ..... *B41F 9/063* (2013.01); *B41F 33/02* (2013.01); *B41F 35/04* (2013.01); *B41F 9/1027* (2013.01); *B41P 2235/21* (2013.01); *B41P 2235/26* (2013.01)

USPC ..... 101/364; 101/351.1; 101/169

(58) Field of Classification Search

CPC ..... B41F 9/1036; B41F 9/066; B41F 9/1027; B41F 9/063; B41F 9/1081; B41F 31/001; B41F 31/02; B41F 31/04; B41F 31/06; B41F 31/07; B41F 31/30

USPC ..... 101/364, 352.01, 351.1, 350.1, 157, 101/169

See application file for complete search history.

(56) References Cited

U.S. PATENT DOCUMENTS

| | | | | |
|---|---|---|---|---|
| 1,843,048 | A | 1/1932 | Spence | |
| 2,026,480 | A * | 12/1935 | Lougee | 101/350.5 |
| 6,142,073 | A * | 11/2000 | Zeman et al. | 101/216 |
| 6,283,024 | B1 * | 9/2001 | George | 101/182 |
| 6,418,848 | B1 * | 7/2002 | Fujimoto et al. | 101/367 |

(Continued)

FOREIGN PATENT DOCUMENTS

| | | |
|---|---|---|
| CN | 1436663 A | 8/2003 |
| CN | 1865000 A | 11/2006 |

(Continued)

*Primary Examiner* — Jill Culler
*Assistant Examiner* — Leo T Hinze
(74) *Attorney, Agent, or Firm* — Blakely Sokoloff Taylor & Zafman

(57) ABSTRACT

An ink supply apparatus of a printing press includes at least one inking device. In the inking device, an ink fountain roller is rotatably supported. An ink fountain main body forms a space to store an ink together with an outer surface of the ink fountain roller. A guide member slidably supports the ink fountain main body and guides the ink fountain main body between a first position where the space is formed and a second position spaced apart from the ink fountain roller than the first position. A doctor including a blade is attached to a doctor holding member between the ink fountain main body and the ink fountain roller when the ink fountain main body is located at the second position. The blade abuts against the ink fountain roller and cleans the ink fountain roller.

16 Claims, 11 Drawing Sheets

(56) References Cited

U.S. PATENT DOCUMENTS

| | | | | |
|---|---|---|---|---|
| 7,117,791 | B2 * | 10/2006 | Matsuura | 101/350.5 |
| 7,124,862 | B2 * | 10/2006 | Hayford et al. | 188/79.55 |
| 8,408,127 | B2 * | 4/2013 | Nielsen | 101/350.6 |
| 2006/0260486 | A1 | 11/2006 | Kusaka | |

FOREIGN PATENT DOCUMENTS

| | | | |
|---|---|---|---|
| CN | 2931112 | Y | 8/2007 |
| EP | 1 038 673 | A1 | 9/2000 |
| EP | 1 316 422 | A2 | 6/2003 |
| EP | 1 504 898 | A1 | 2/2005 |
| JP | S61-037432 | A | 2/1986 |
| JP | 11-342594 | | 12/1999 |
| JP | 2001-001501 | A | 1/2001 |
| JP | 2001-071459 | A | 3/2001 |
| JP | 2001-328240 | A | 11/2001 |
| JP | 2010-269447 | A | 12/2010 |
| WO | WO 2009140969 | A1 * | 11/2009 |

* cited by examiner 11
51
70
78
30a
18
11b
12a
13
30
14a
13a
12
16
14
14a
13
12a
30a
11b
18
52
70
78

11
51
51a
11b
30a
18
18
56
12a
14a
12b
30
14
12
14a
12a
18
56
30a
18
52a
11b
52

33
32
19
30
31
83
70
11b
16
14
13
14a
11
15
18
12b
12
18
12a

INK SUPPLY APPARATUS OF PRINTING PRESS

BACKGROUND OF THE INVENTION

The present invention relates to an ink supply apparatus of a printing press.

The ink supply apparatus of a multicolor printing press includes an inking device for supplying an ink for each ink color. Japanese Patent Laid-Open No. 2001-328240 describes a conventional inking device. This inking device includes an ink fountain roller supported rotatably, and an ink fountain device supported to be close to or apart from the ink fountain roller. The position of the ink fountain device can be switched between a fixed position (throw-on position) close to the ink fountain roller, a throw-off position spaced apart from the ink fountain roller, and an intermediate position between the fixed position and the throw-off position. The ink is cleaned in a state in which the ink fountain position is switched to the throw-off position.

The ink fountain device is swingably supported by a pivot. A rigid ball assembled to a lock handle selectively engages with three engaging grooves formed in each of the inner surfaces of the left and right frames, thereby switching the position of the ink fountain device between the fixed position, the throw-off position, and the intermediate position.

However, in an arrangement in which the inking devices are arranged at a deep position in the machine or an arrangement in which the plurality of inking devices are arranged vertically along the outer surface of an intaglio cylinder or a collecting blanket cylinder as in, for example, the ink supply apparatus of an intaglio printing press, cleaning the ink or the ink fountain roller is time-consuming, and physical load on the operator is heavy.

SUMMARY OF THE INVENTION

The present invention has been made to solve the above-described problems, and has as its object to provide an ink supply apparatus of a printing press which can efficiently clean an ink and an ink fountain roller with minimum physical load on an operator.

In order to achieve the above-described object, according to the present invention, there is provided an ink supply apparatus of a printing press, comprising at least one inking device including an ink fountain roller that is rotatably supported, an ink fountain main body that forms a space to store an ink together with an outer surface of the ink fountain roller, a guide member that slidably supports the ink fountain main body and guides the ink fountain main body between a first position where the space is formed and a second position spaced apart from the ink fountain roller than the first position and a doctor holding member to which a doctor including a blade is attached between the ink fountain main body and the ink fountain roller when the ink fountain main body is located at the second position, the blade abutting against the ink fountain roller and cleaning the ink fountain roller.

BRIEF DESCRIPTION OF THE DRAWINGS

FIG. 2A is a plan view, FIG. 2B is a rear view, and FIG. 2C is a side view;

FIG. 3A is a plan view, FIG. 3B is a rear view, and FIG. 3C is a side view;

FIG. 7A is a plan view, FIG. 7B is a rear view, and FIG. 7C is a side view;

DESCRIPTION OF THE PREFERRED EMBODIMENTS

An embodiment of the present invention will now be described in detail with reference to the accompanying drawings. In the embodiment, a case will be explained in which the present invention is applied to the ink supply apparatus of an intaglio printing press in which a plurality of inking devices are arranged vertically along the outer surface of an intaglio cylinder.

1. Overall Arrangement of Ink Supply Apparatus

Figure 1:
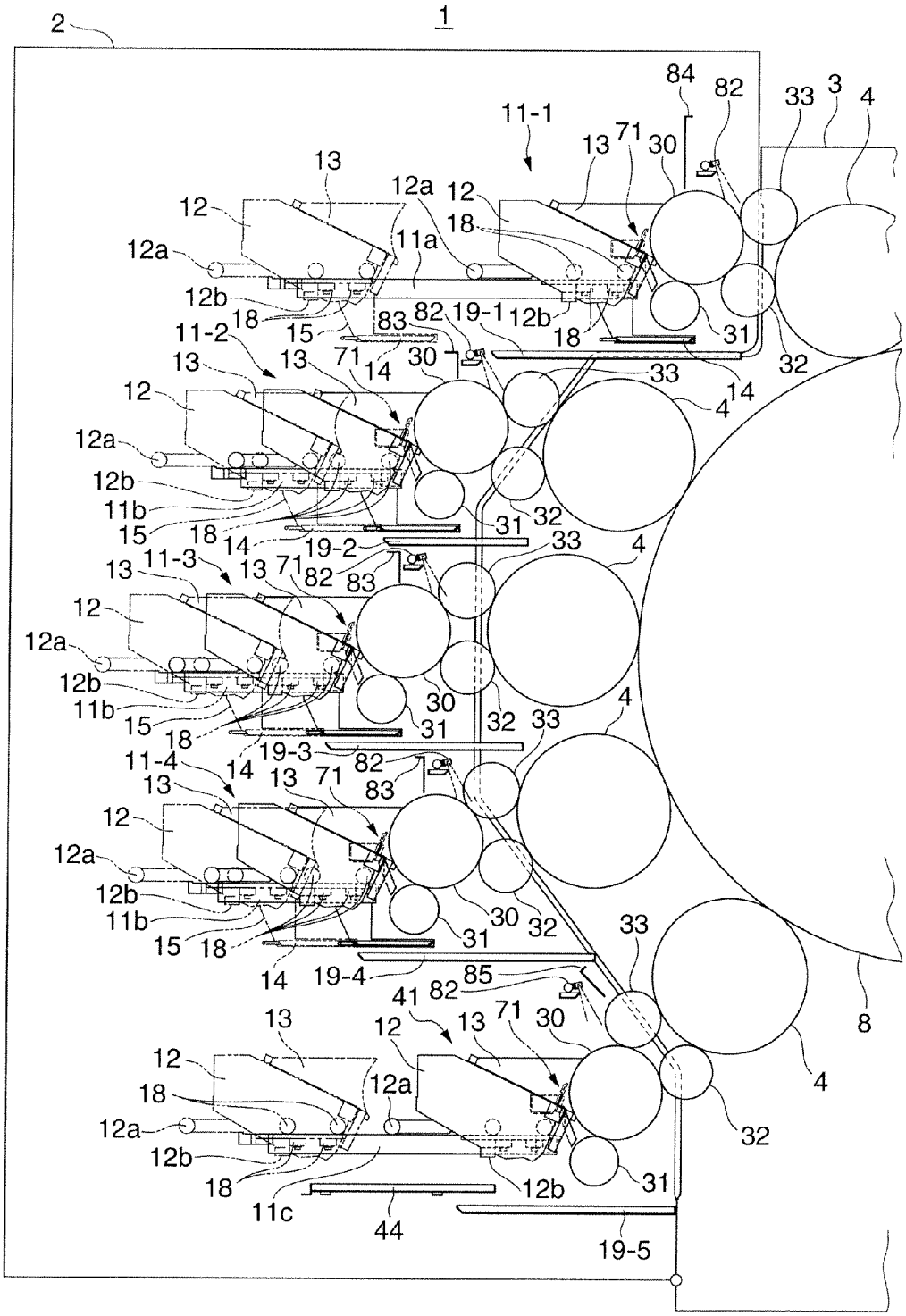
FIG. 1 is a side view showing the overall arrangement of an ink supply apparatus.

FIG. 1 shows the overall arrangement of an ink supply apparatus of an intaglio printing press according to an embodiment of the present invention. An ink supply apparatus 1 includes an ink supply unit 2 serving as an ink supply system, and a print processing unit 3 that performs print processing using ink supplied from the ink supply unit 2.

The print processing unit 3 includes an intaglio cylinder 8, and five chevron cylinders (blanket cylinders) 4 arranged in contact with the outer surface of the intaglio cylinder 8. The five chevron cylinders 4 are arranged while being spaced apart from each other at a predetermined interval vertically along the circumferential direction of the intaglio cylinder 8.

The ink supply unit 2 includes five inking devices corresponding to the five chevron cylinders 4, respectively. The five inking devices are arranged while being spaced apart from each other at a predetermined interval vertically. The inking devices in the uppermost stage (first stage), the second stage, the third stage, and the fourth stage will be referred to as inking devices 11-1, 11-2, 11-3, and 11-4, and the inking device in the lowermost stage (fifth stage) will be referred to as an inking device 41.

The inking devices 11-1 to 11-4 fundamentally have a common structure. Hence, the arrangement of the inking device 11-2 in the second stage will be explained as the representative of the inking devices 11-1 to 11-4. The arrangement of the inking device 41 in the lowermost stage will be described then. The inking device 11-2 will sometimes be referred to as the inking device 11 hereinafter.

2. Arrangement of Inking Device

As shown in FIGS. 2A to 2C and FIGS. 3A to 3C, the inking device 11 includes an ink fountain roller 30, an ink fountain main body 12, and three ink rollers 31, 32, and 33. The ink fountain roller 30 is rotatably supported by left and right frames 51 and 52. The ink fountain main body 12 is supported to be movable close to or away from the ink fountain roller 30 and forms a space 13*a* to store an ink together with the outer surface of the ink fountain roller 30. The two ink rollers 32 and 33 contact the ink fountain roller 30 and the chevron cylinder 4. The ink roller 31 under the ink fountain roller 30 contacts the ink fountain roller 30.

The inking device 11 also includes two slide rails 11*b* provided on the left and right frames 51 and 52 and serving as guide members. The slide rails 11*b* run in a direction perpendicular to the rotating shaft of the ink fountain roller 30. The slide rails 11*b* slidably support the ink fountain main body 12 on its left and right sides, and guide the ink fountain main body 12 between the position (to be referred to as a "first position" hereinafter) shown in FIG. 2C where the ink fountain main body 12 comes close to or contacts the ink fountain roller 30 and the position (to be referred to as a "second position" hereinafter) shown in FIG. 3C spaced apart from the ink fountain roller 30 than the first position. Upon printing, the ink fountain main body 12 is located at the first position to form the storage space 13*a*, and the ink stored in the storage space 13*a* is extracted by the ink fountain roller 30. Upon non-printing, the ink fountain main body 12 is located at the second position, and a wide space is formed between the ink fountain main body 12 and the ink fountain roller 30.

A total of eighth cam followers (rollers) 18 are provided, of which four cam followers are provided on each of the left and right sides of the ink fountain main body 12. The eight cam followers 18 engage with the left and right slide rails 11*b*. More specifically, a pair of cam followers 18 are arranged at an angle of 90°. One cam follower 18 abuts against the upper surface of the slide rail 11*b*, and the other cam follower 18 abuts against the side surface of the slide rail 11*b*. Two pairs of cam followers 18 are disposed on each side.

On the upper surface of the ink fountain main body 12 serving as the bottom of the space 13*a*, a pair of ink weirs 13 are vertically arranged at two ends in a direction parallel to the axial direction of the ink fountain roller 30. The storage space 13*a* whose section perpendicular to the axial direction has an almost triangular shape is formed by the upper surface of the ink fountain main body 12, the outer surface of the ink fountain roller 30, and the pair of ink weirs 13.

A blade 16 for gap adjustment is attached to the distal end of the upper surface of the ink fountain main body 12 while facing the outer surface of the ink fountain roller 30. The blade 16 is movably supported to adjust the gap amount between the ink fountain main body 12 and the outer surface of the ink fountain roller 30.

Note that an ink fountain is formed by the ink fountain main body 12, the ink weirs 13, the blade 16 for gap adjustment, and the ink fountain roller 30.

The inking device 11 further includes an ink pan 14, and a holding member 15 serving as an ink pan holding portion for holding the ink pan 14. The arrangement of the ink pan 14 and the holding member 15 will be described below with reference to FIGS. 4A, 4B, 5, 6A, and 6B as well.

Figure 4A:
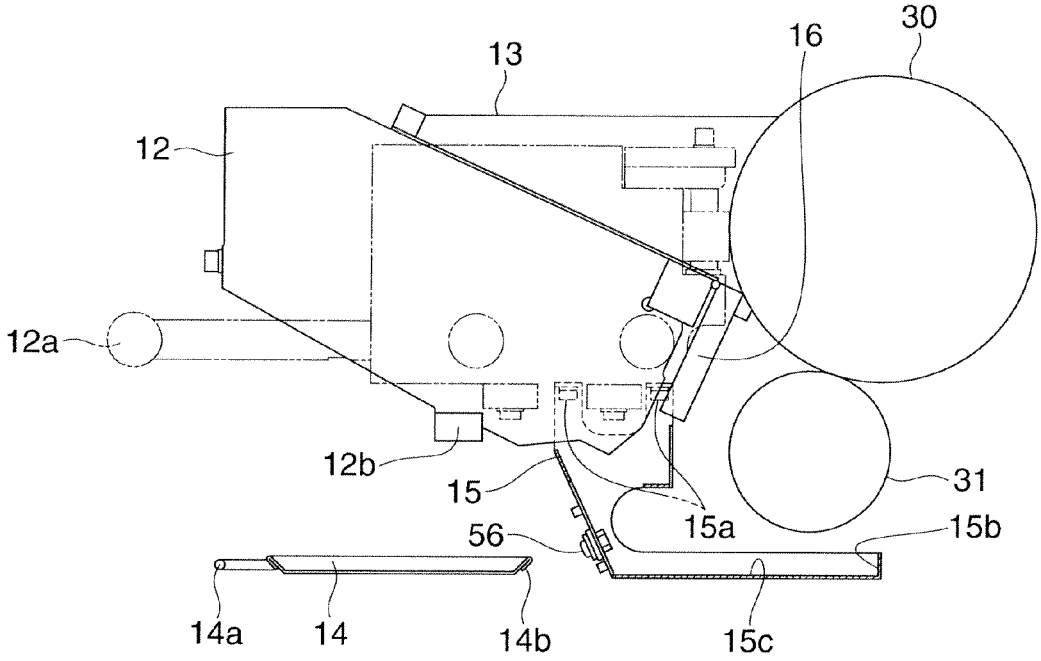
FIG. 4A is a side view showing a state before an ink pan is set in a holding member.
Figure 4B:
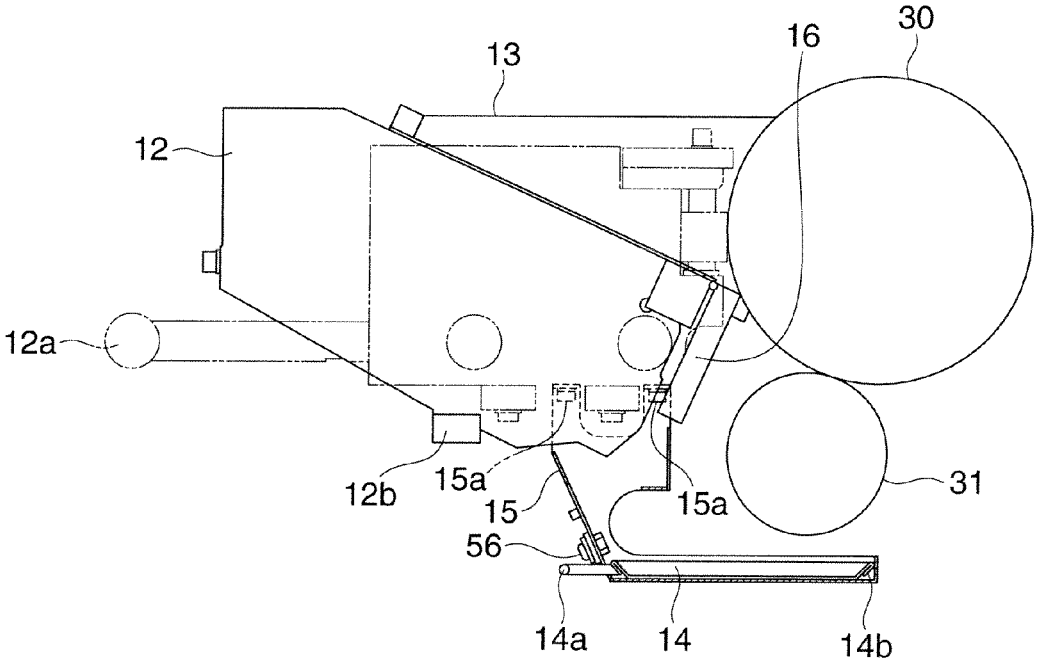
FIG. 4B is a side view showing a state in which the ink pan is set in the holding member.

As shown in FIG. 4A, the holding member 15 is formed to have a section having an almost L shape and attached to the lower portion of the ink fountain main body 12 by screws 15*a*. The holding member 15 has a base plate 15*c* located under the distal end (on the side of the ink fountain roller 30) of the ink fountain main body 12. The base plate 15*c* has almost the same area as that of the ink pan 14. The ink pan 14 is placed on the base plate 15*c*. Hence, the ink pan 14 is supported by the holding member 15 under the distal end of the ink fountain main body 12 to move integrally with the ink fountain main body 12.

Figure 5:
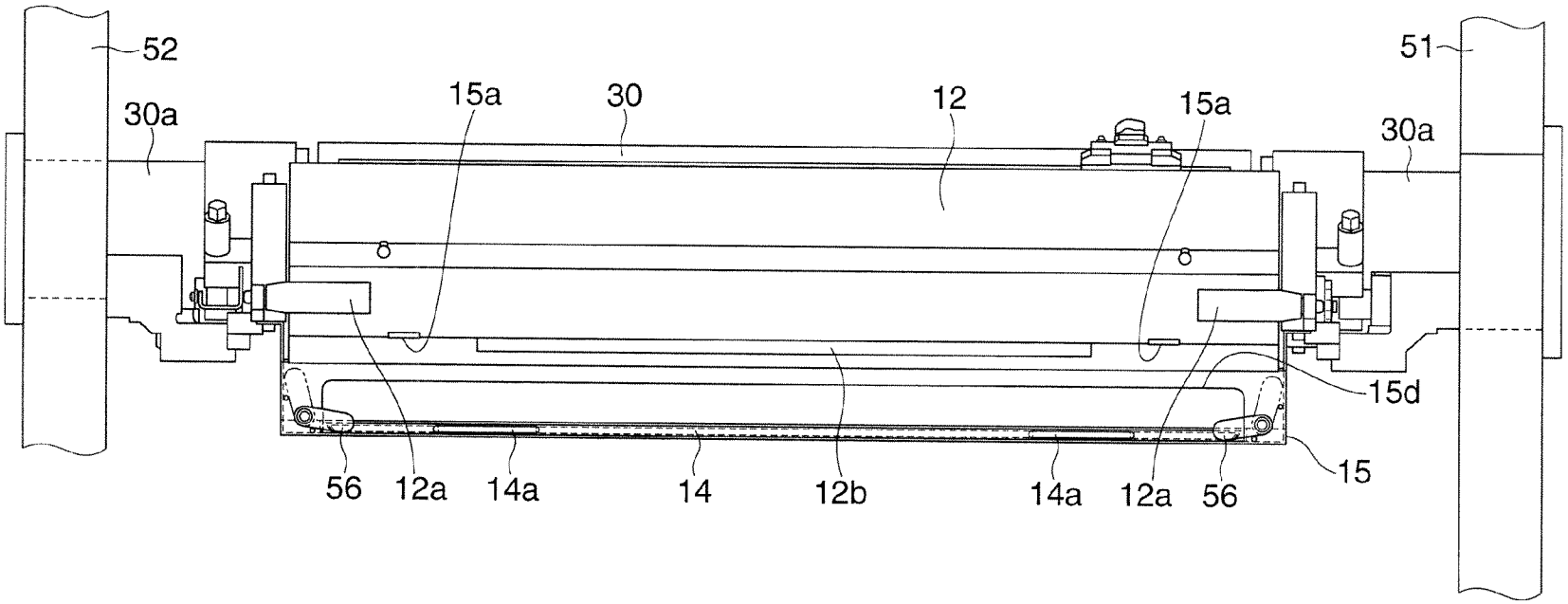
FIG. 5 is a rear view showing a state in which the ink pan is set in the holding member.
Figure 6A:
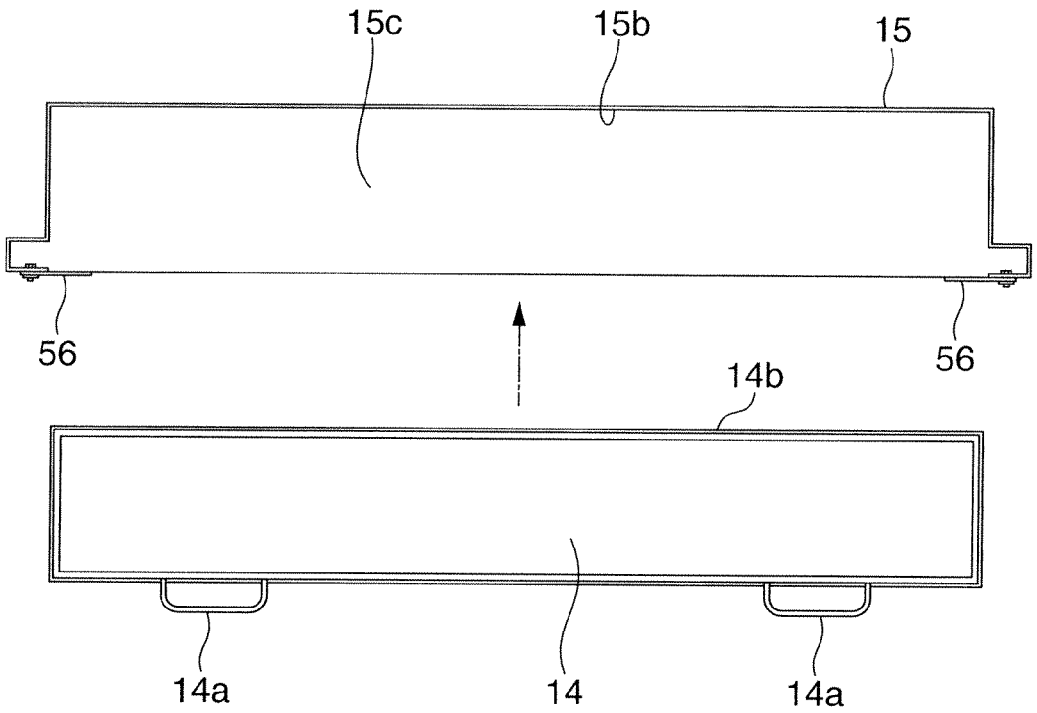
FIG. 6A is a plan view showing a state before the ink pan is set in the holding member.
Figure 6B:
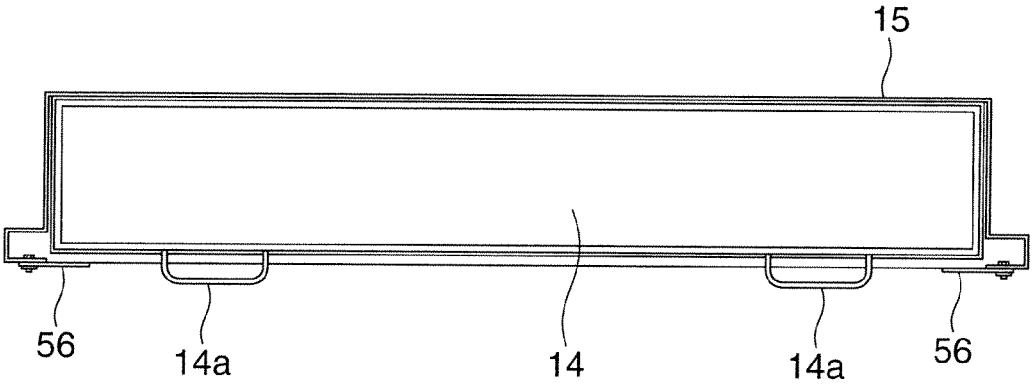
FIG. 6B is a plan view showing a state in which the ink pan is set in the holding member.

The ink pan 14 is attachable to or detachable from the holding member 15. The ink pan 14 is detachably attached to the holding member 15. As shown in FIG. 5, an opening 15*d* whose size enables to insert or remove the ink pan 14 is formed at the rear end (on the side opposite to the print processing unit 3) of the holding member 15.

As shown in FIG. 4A, an inner wall 15*b* serving as a stopper against which a distal end 14*b* of the ink pan 14 abuts is provided at the distal end (on the side of the print processing unit 3) of the holding member 15, that is, the distal end of the base plate 15*c*.

To prevent the ink pan 14 from exiting from the opening 15*d*, lock levers 56 serving as regulating members for regulating the movement of the rear end of the ink pan 14 is provided at the rear end of the holding member 15, as shown in FIG. 5. Each lock lever 56 is supported to pivot between an open position (the position indicated by the alternate long and two short dashed line in FIG. 5) where the opening 15*d* is opened to enable insertion and removal of the ink pan 14 via the opening 15*d* and a lock position (the position indicated by the solid line in FIG. 5) where the lock lever 56 covers part of the opening 15*d* to disable insertion and removal of the ink pan 14.

Pan handles 14*a* are provided at the rear end of the ink pan 14.

When the ink fountain main body 12 is located at the above-described first position (see FIG. 2C), the ink pan 14 is disposed under (immediately under) the ink fountain main body 12 and also under (immediately under) the ink roller 31 integrally with the ink fountain main body 12 via the holding member 15. For this reason, the ink pan 14 can receive the ink dropping from the distal end of the ink fountain main body 12 or the ink roller 31.

Figure 2A:
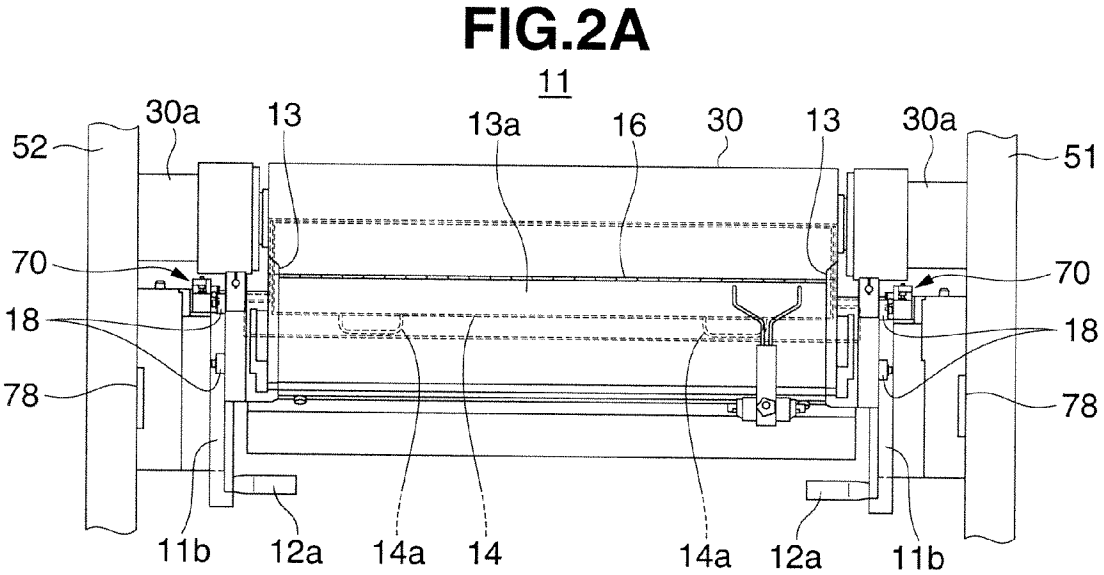
FIGS. 2A to 2C are views showing the state of an inking device when an ink fountain main body is located at a first position in which, in particular.
Figure 2B:
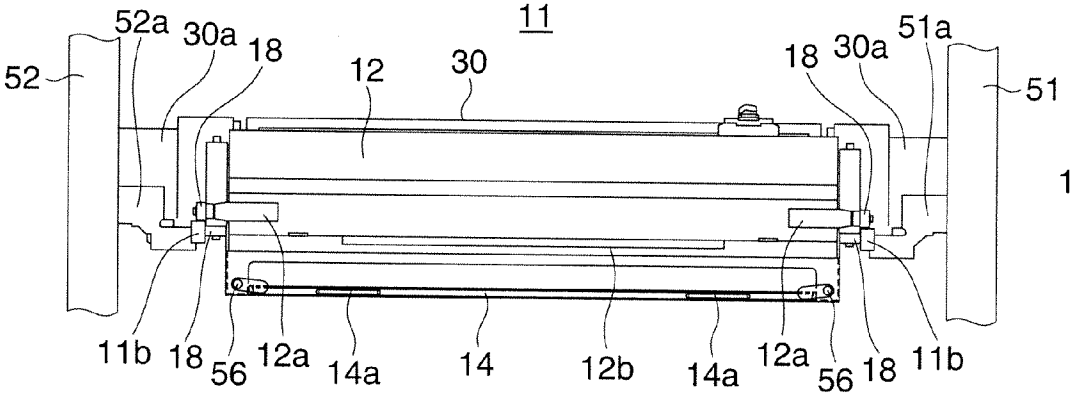
Figure 2C:
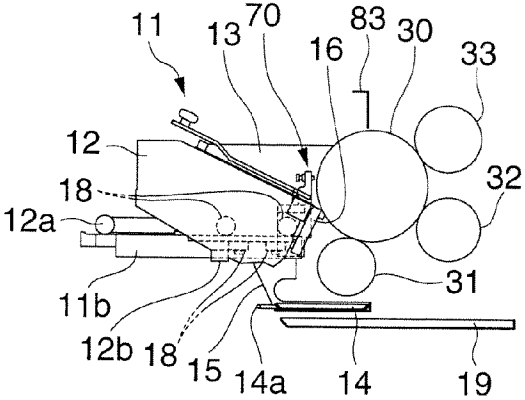
Figure 3A:
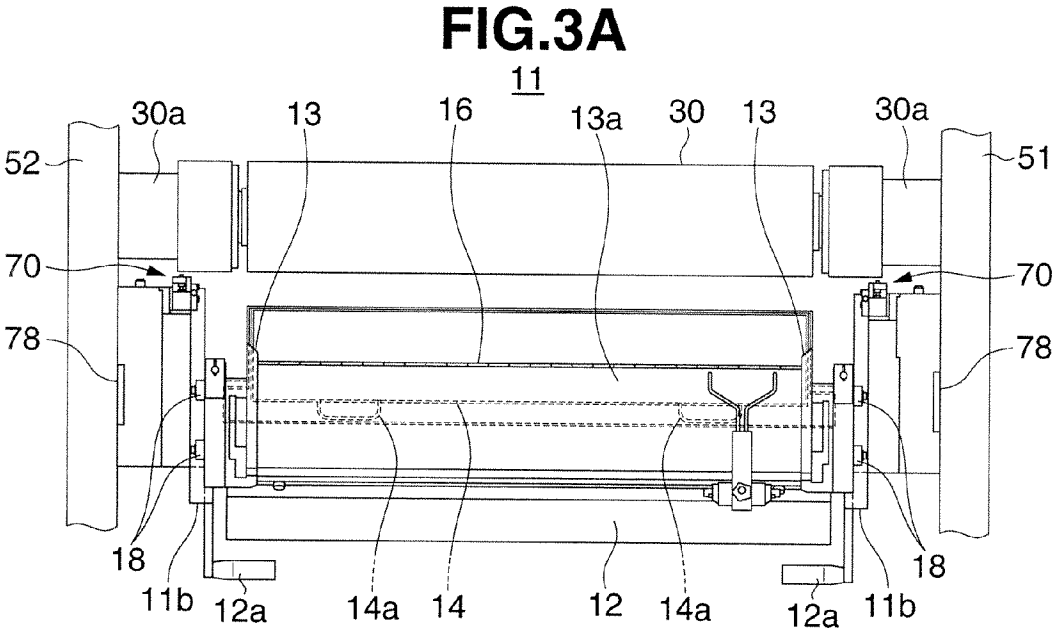
FIGS. 3A to 3C are views showing the state of the inking device when the ink fountain main body is located at a second position in which, in particular.
Figure 3B:
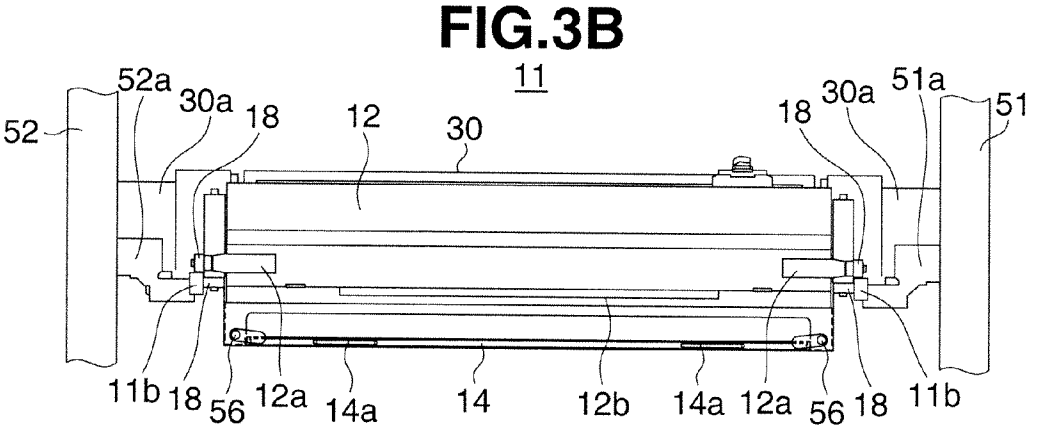
Figure 3C:
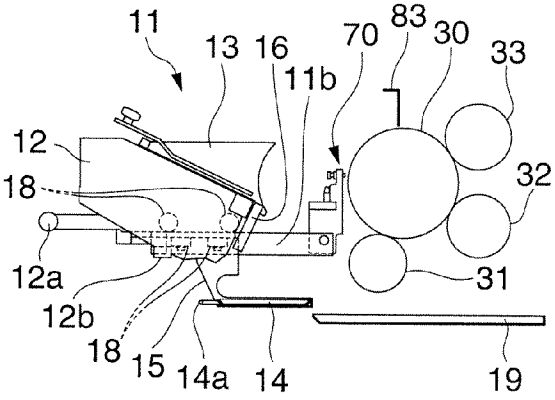

As shown in FIGS. 2C and 3C, the inking device 11 also includes a fixed pan 19 stationarily arranged under (immediately under) the distal end of the ink fountain main body 12, the ink fountain roller 30, and the ink roller 31 and attached to the frames 51 and 52 of the ink supply unit 2. When the ink fountain main body 12 is located at the first position (see FIG. 2C) upon printing, the fixed pan 19 is located under the ink pan 14 integrated with the ink fountain main body 12 (at this time, the ink pan 14 is located above the fixed pan 19).

Hence, when the ink fountain main body 12 is located at the first position upon printing, the base plate 15*c* of the holding member 15 or the ink pan 14 and the fixed pan 19 are located under (immediately under) the distal end of the ink fountain main body 12 and under (immediately under) the ink fountain roller 30 or the ink roller 31.

On the other hand, when the ink fountain main body 12 is located at the second position (see FIG. 3C) upon non-printing, the base plate 15*c* of the holding member 15 or the ink pan 14 is located under (immediately under) the distal end of the ink fountain main body 12, and the fixed pan 19 is located under (immediately under) the ink fountain roller 30 or the ink roller 31, so that the base plate 15*c* of the holding member 15 or the ink pan 14 and the fixed pan 19 are disposed continuously in the moving direction of the ink fountain main body 12. Hence, the base plate 15*c* of the holding member 15 or the ink pan 14 and the fixed pan 19 cover the space under the inking device 11 in the range from the distal end of the ink fountain main body 12 to the ink fountain roller 30 or the ink roller 31.

As shown in FIG. 1, the fixed pans 19 (19-1, 19-2, 19-3, and 19-4) of the inking devices 11-1 to 11-4 in the uppermost to fourth stages are formed into different sizes in accordance with the slide amount of the ink fountain main body 12 to be described later so that the base plate 15*c* of the holding member 15 or the ink pan 14 and the fixed pan 19 are arranged continuously when the ink fountain main body 12 is located at the second position.

The inking device 41 in the lowermost stage includes a fixed pan 19-5, like the inking devices 11-1 to 11-4. However, the holding member 15 and the ink pan 14 are not attached to the ink fountain main body 12, unlike the inking devices 11-1 to 11-4. Instead, the inking device 41 includes a fixed pan 44 capable of receiving the ink dropping from the distal end of the ink fountain main body 12 when the ink fountain main body 12 is located at the second position (see FIG. 3C) upon non-printing. The fixed pan 44 is arranged while partially overlapping the fixed pan 19-5. Hence, the fixed pan 19-5 and the fixed pan 44 are disposed continuously between the first position and the second position of the ink fountain main body 12.

Each of the inking devices 11-1 to 11-4 and the inking device 41 includes, under the ink fountain main body 12, an illumination 12*b* that illuminates the lower part of the ink fountain main body 12. The illumination 12*b* is formed from, for example, an LED (Light Emitting Diode). The illuminations 12*b* of the inking devices 11-1 to 11-4 can illuminate the ink fountain main bodies 12 of the inking devices 11-2 to 11-4 and 41 immediately under (in stages under) them and vicinities thereof.

3. Layout of Inking Devices

As described above, in the ink supply unit 2, the inking devices 11-1 to 11-4 in the uppermost to fourth stages fundamentally have a common structure. However, as shown in FIG. 1, the slide distance (or length) of slide rails 11*a* of the inking device 11-1 in the uppermost stage is different from the slide distance (or length) of the slide rails 11*b* of the inking devices 11-2 to 11-4 in the second to fourth stages. In this embodiment, all the inking devices 11-2 to 11-4 have the same slide distance but may have different slide distances.

The slide distance (or length) of slide rails 11*c* of the inking device 41 in the lowermost stage is also different from the slide distances (or lengths) of the slide rails 11*a* and 11*b* of the inking devices 11-1 to 11-4 in the uppermost to fourth stages.

This will be described in more detail. As shown in FIG. 1, the inking device 11-1 in the uppermost stage corresponds to the chevron cylinder 4 in the uppermost stage out of the five chevron cylinders 4 arranged along the circumferential direction of the intaglio cylinder 8. The slide rails 11*a* of the inking device 11-1 have the longest slide distance. Hence, the ink fountain main body 12 of the inking device 1'-1 is supported by the slide rails 11*a* having the longest slide distance to slide the longest distance between the first position upon printing and the second position upon non-printing.

The inking devices 11-2 to 11-4 in the second to fourth stages correspond to the chevron cylinders 4 in the second to fourth stages out of the five chevron cylinders 4 arranged along the circumferential direction of the intaglio cylinder 8. The slide rails 11*b* of the inking devices 11-2 to 11-4 are shorter than the slide rails 11*a* of the inking device 11-1. The ink fountain main bodies 12 of the inking devices 11-2 to 11-4 are supported by the slide rails 11*b* to slide between the first position upon printing and the second position upon non-printing.

As shown in FIG. 1, the chevron cylinders 4 in the second to fourth stages are arranged at positions projecting outward in the circumferential direction from the chevron cylinder 4 in the uppermost stage. Hence, when the slide distance of the slide rails 11*b* is shorter than that of the slide rails 11*a*, the ink fountain main body 12 in the uppermost stage, the ink fountain main body 12 in the second stage, the ink fountain main body 12 in the third stage, and the ink fountain main body 12 in the fourth stage are vertically aligned in a straight line at the second position upon non-printing. More exactly speaking, at the second position upon non-printing, the ink fountain main bodies 12 in the stages are aligned vertically not in a complete straight line but in tiers along the circumference of the intaglio cylinder 8.

The inking device 41 in the lowermost stage corresponds to the chevron cylinder 4 in the lowermost stage arranged at a position projecting outward in the circumferential direction from the chevron cylinder 4 in the uppermost stage. The slide rails 11*c* of the inking device 41 are shorter than the slide rails 11*a* of the inking device 11-1 and longer than the slide rails 11*b* of the inking devices 11-2 to 11-4. The ink fountain main body 12 of the inking device 41 is supported by the slide rails 11*c* to slide between the first position upon printing and the second position upon non-printing.

4. Arrangement of Doctor

The description of the arrangement of the inking device 11-2 (11) in the second stage of the ink supply unit 2 will be continued. As shown in FIGS. 2A, 2C, 3A, and 3C, the inking device 11 includes a doctor holding member 70. The doctor holding member 70 is attached to the ends of the left and right slide rails 11*b* on the side of the ink fountain roller 30.

Figure 7A:
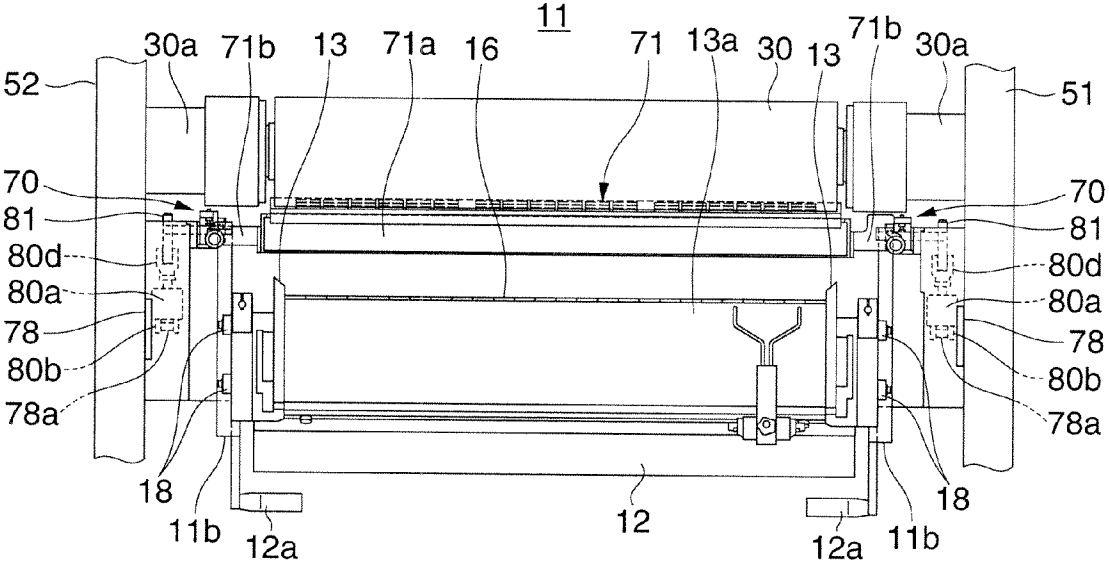
FIGS. 7A to 7C are views showing a state in which a doctor is set in the inking device in which, in particular.
Figure 7B:
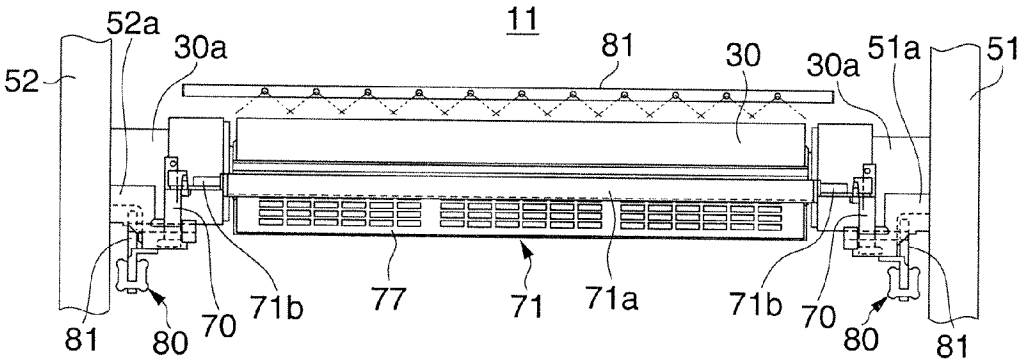
Figure 7C:
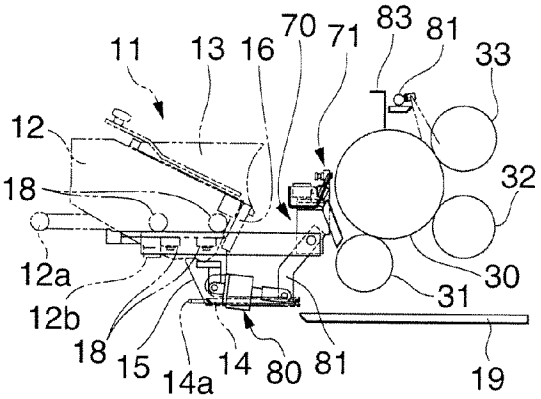

As shown in FIGS. 7A to 7C, when the ink fountain main body 12 is located at the second position upon non-printing along the slide rails 11*b*, a doctor 71 is set on the doctor holding member 70 using the space formed between the ink fountain main body 12 and the ink fountain roller 30. The doctor 71 is attachable to or detachable from the doctor holding member 70. The arrangement of the doctor 71 will be described below with reference to FIGS. 8 to 10 in addition to FIGS. 7A to 7C.

Figure 8:
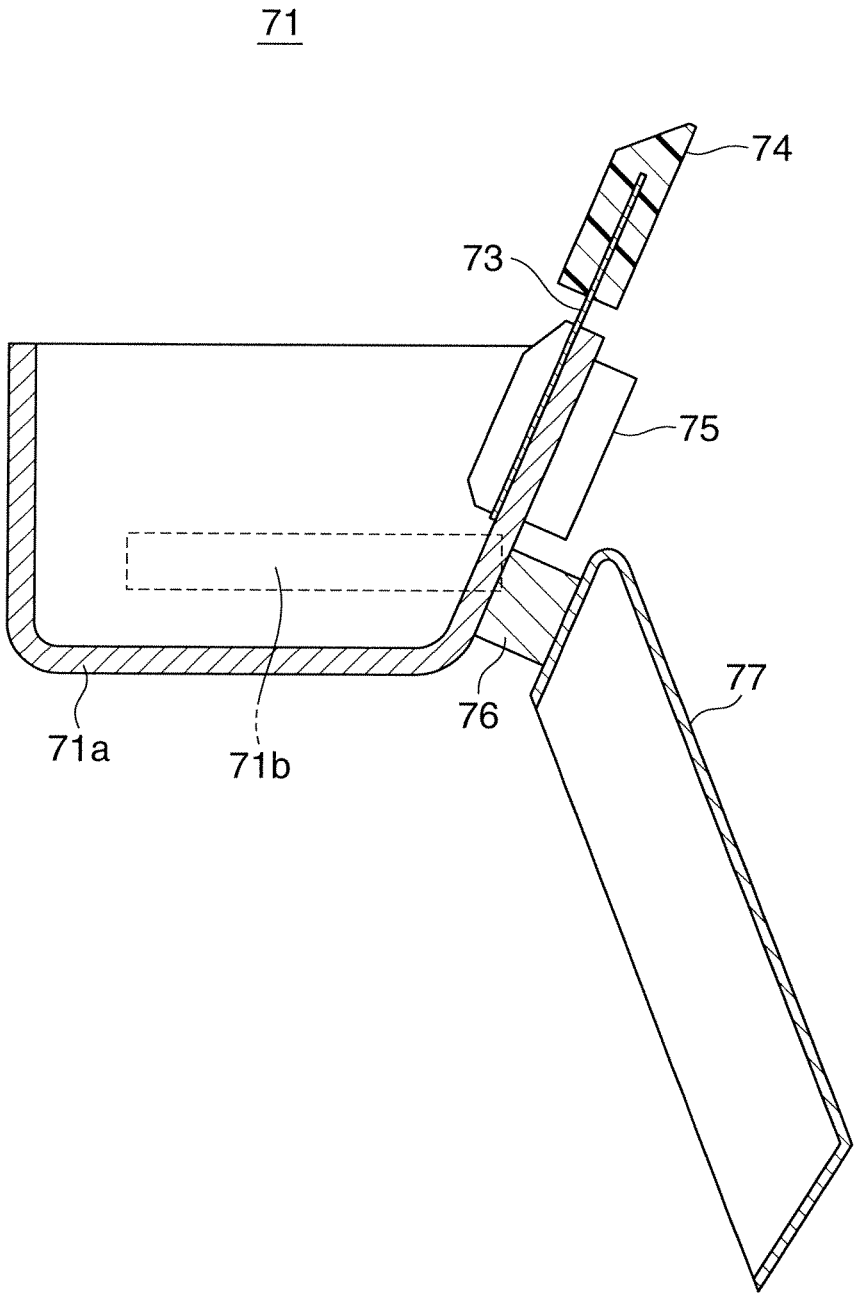
FIG. 8 is a sectional view showing the arrangement of the doctor set in the inking device.

As shown in FIGS. 7A and 8, the doctor 71 includes a doctor blade 74 and a catch pan 71*a*. The length of the doctor blade 74 is almost equal to the axial length of the outer surface of the ink fountain roller 30. The distal end of the doctor blade 74 abuts against the ink fountain roller 30 and cleans it. The catch pan 71*a* has an almost rectangular parallelepiped shape with a length almost equal to the axial length of the outer surface of the ink fountain roller 30. The catch pan 71*a* has an opening at the upper portion, and a space to store a cleaning fluid is formed inside.

Figure 9:
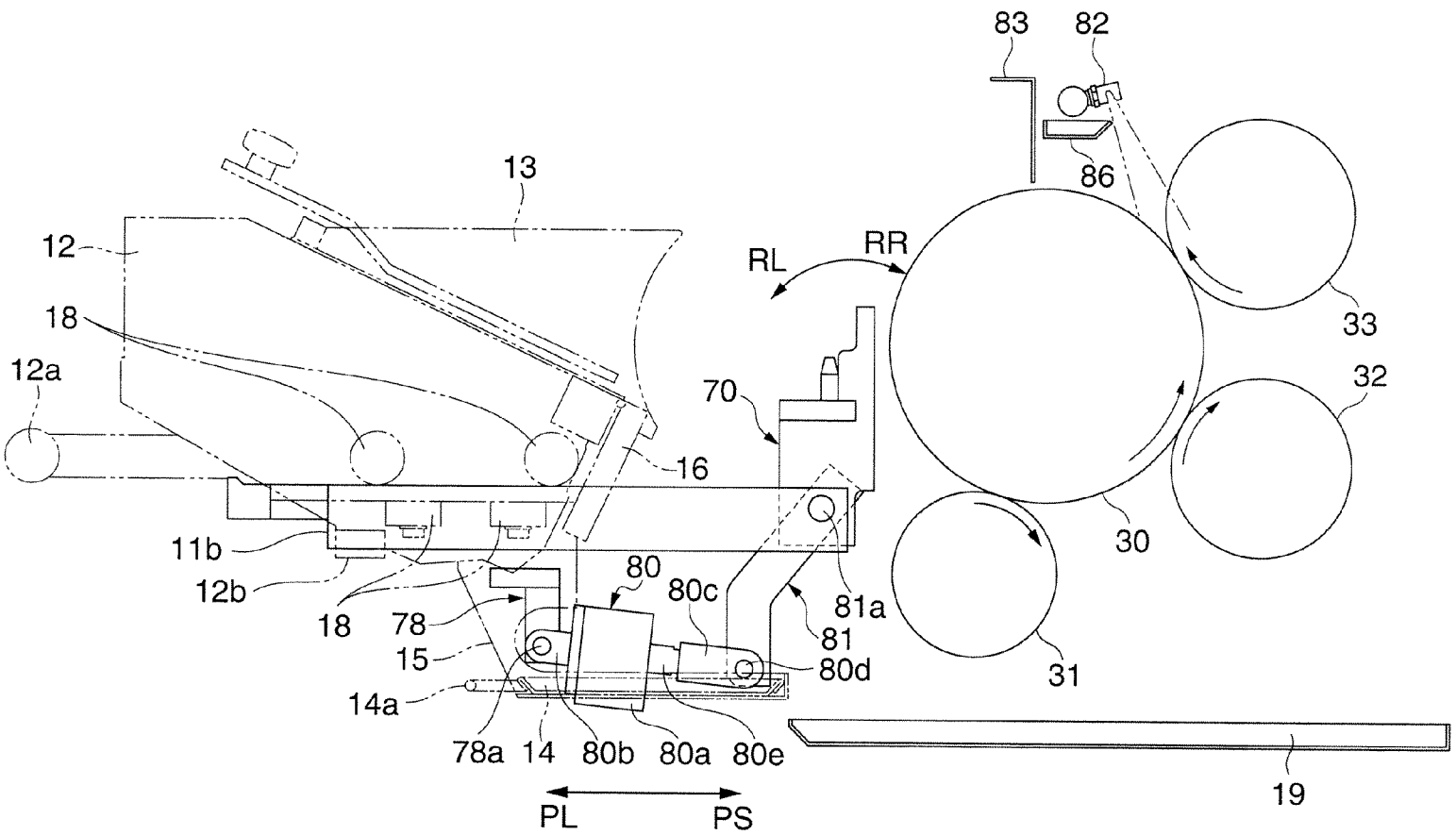
FIG. 9 is a side view showing a state before the doctor is set in the inking device.
Figure 10:
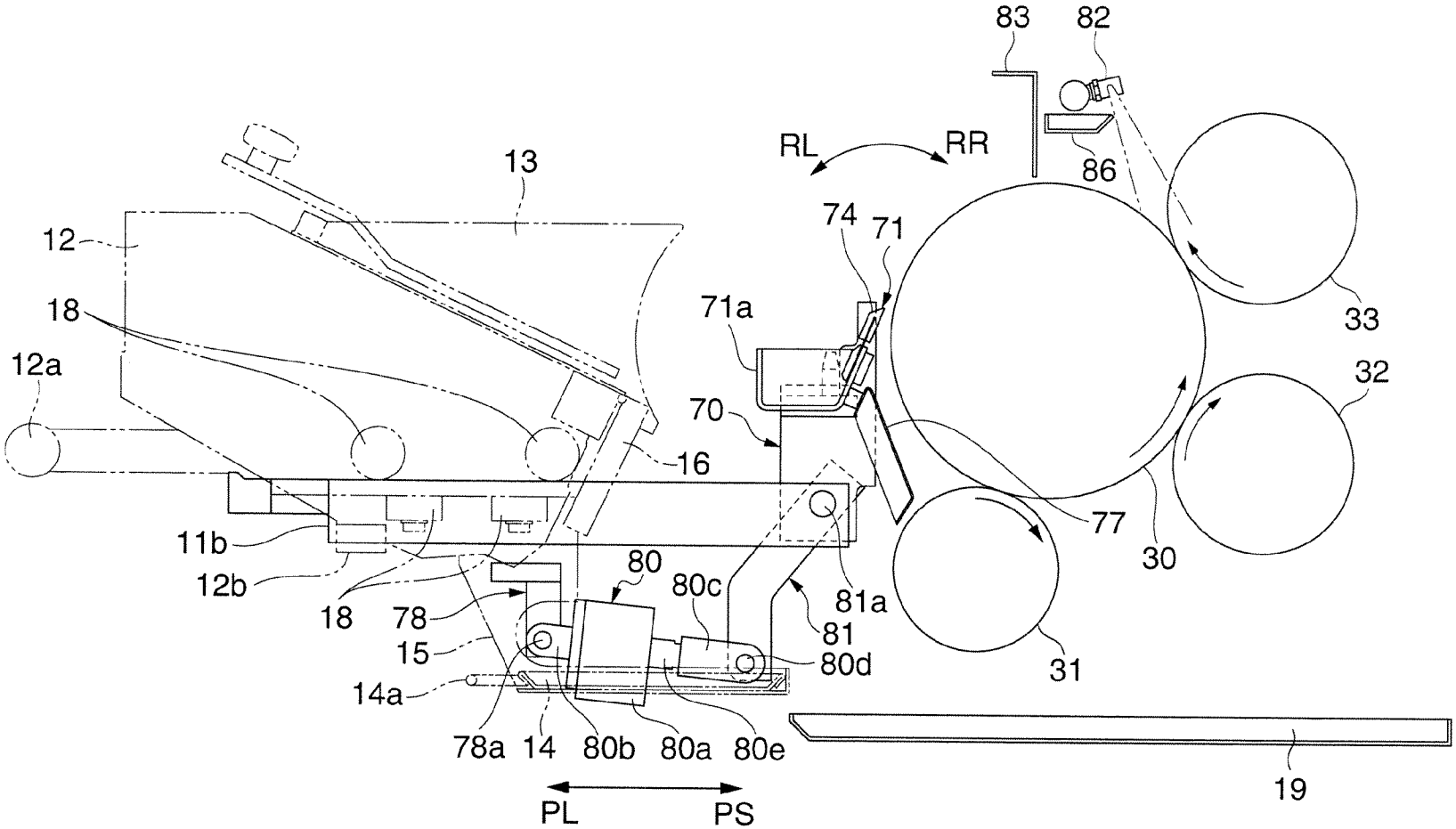
FIG. 10 is a side view showing a state after the doctor is set in the inking device.

Engaging portions 71*b* to be used when setting the doctor 71 on the doctor holding member 70 are provided on the left and right sides of the catch pan 71*a*. The engaging portions 71*b* are fixed to the doctor holding member 70 by bolts (not shown), thereby attaching the doctor 71 to the doctor holding member 70. FIG. 9 shows a state before the doctor 71 is set on the doctor holding member 70. FIG. 10 shows a state after the doctor 71 is set on the doctor holding member 70.

As shown in FIG. 8, an extending portion 73 formed from a plate (for example, thin metal leaf spring) is fixed on the side wall of the catch pan 71*a* on the side of the ink fountain roller 30 by screws 75 or the like. The proximal end of the doctor blade 74 is attached to the distal end of the extending portion 73. The doctor blade 74 is made of a resin or plastic.

The doctor 71 is provided with a cover 77 serving as a second cover extending under the catch pan 71*a*. A support 76 is fixed to the lower side of the side wall of the catch pan 71*a* on the side of the ink fountain roller 30. The cover 77 is attached to the support 76. The cover 77 covers the space under the doctor 71, prevents foreign substances from entering from the ink fountain main body 12 to the ink fountain roller 30 and the contact portion between the ink fountain roller 30 and the ink roller 31, and protects the ink fountain roller 30 and the ink roller 31.

Note that as a plurality of holes each having a rectangular shape are formed in the surface of the cover 77, as shown in FIG. 7B. The operator can visually confirm the state of the ink fountain roller 30 from outside of the cover 77 through the plurality of holes.

As shown in FIGS. 7A, 9, and 10, support plates 78 extending under the ink fountain main body 12 are fixed to the frames 51 and 52 of the ink supply unit 2. A proximal end 80*b* of an air cylinder 80 is pivotally supported by each support plate 78 via a shaft 78*a*. One end of an arm 81 is pivotally connected, via a shaft 80*d*, to a distal end 80*c* of a rod 80*e* of the air cylinder 80. The other end of the arm 81 is fixed to a pivot shaft 81*a* pivotally supported by the slide rail 11*b*. The doctor holding member 70 on which the doctor 71 is set is fixed to the pivot shafts 81*a*. A doctor blade abutting and separating unit is formed by the doctor holding member 70, the pivot shafts 81*a*, the air cylinders 80, the arms 81, and a solenoid valve 65 to be described later.

In the inking device 11, an injection nozzle 82 that injects a cleaning fluid made of a solvent to clean the ink fountain roller 30 and the ink rollers 31, 32, and 33 is provided above the ink fountain roller 30. The injection nozzle 82 is supported by the frames 51 and 52 while being directed to the contact portion between the ink fountain roller 30 and the ink roller 33. This allows the injection nozzle 82 to inject and spray the cleaning fluid from it toward the portion between the ink fountain roller 30 and the ink roller 33. A cleaning fluid supply unit is formed by the injection nozzle 82 and a solenoid valve 64 to be described later. A catch pan 86 for receiving the cleaning fluid dropping from the injection nozzle 82 is provided under the injection nozzle 82.

5. Structure to Prevent Entry to Machine

An entry preventing structure that prevents foreign substances from entering the machine of the ink supply apparatus 1 (or printing press) when the ink fountain main bodies 12 in the inking devices 11-1 to 11-4 and 41 of the ink supply unit 2 are located at the second position upon non-printing will be described by exemplifying the inking device 11-2 (11) in the second stage.

As shown in FIGS. 9 and 10, the inking device 11 includes a cover 83 serving as a first cover at a position above the ink fountain roller 30 and close to the injection nozzle 82 on the side of the ink fountain main body 12. The width of the cover 83 is almost equal to the width of the outer surface of the ink fountain roller 30. The cover 83 has an almost L-shaped section. The cover 83 is made of a resin or the like. The cover 83 is attached to the frames 51 and 52. The cover 83 covers the space above the ink fountain roller 30 and prevents foreign substances from entering from above the ink fountain roller 30 to the machine of the ink supply apparatus 1.

The cover 83 is disposed such that its bent distal end is arranged near the distal ends of the holding member 15 and the ink pan 14 (the ends on the side of the ink fountain roller 30) of the inking device in the stage immediately above (for example, the inking device 11-1 in the uppermost stage for the inking device 11-2 in the second stage) when the ink fountain main body 12 of the inking device in the stage immediately above is located at the second position (the position indicated by the alternate long and two short dashed line in FIG. 1). For this reason, the cover 83 covers the space between the ink fountain roller 30 in the same stage as the cover 83 and the ink pan or the fixed pan 19 of the inking device in the stage immediately above. Hence, the cover 83 also prevents foreign substances from entering the machine of the ink supply apparatus 1.

When the doctor 71 is attached to the doctor holding member 70, the lower end of the cover 77 of the doctor 71 is arranged near the outer surface of the ink roller 31 and covers the lower portion of the outer surface of the ink fountain roller 30 and the front surface (the surface on the side of the ink fountain main body 12) of the contact portion between the ink fountain roller 30 and the ink roller 31. The cover 77 prevents foreign substances from entering from the lower side of the ink fountain roller 30 to the ink fountain roller 30, in particular, to the contact portion between the ink fountain roller 30 and the ink roller 31.

In addition, when the ink fountain main body 12 is located at the second position upon non-printing, the base plate 15*c* of the holding member 15 or the ink pan 14 and the fixed pan 19 are disposed continuously in the moving direction of the ink fountain main body 12 and cover the lower space in the range from the distal end of the ink fountain main body 12 to the ink fountain roller 30 or the ink roller 31. Foreign substances are thus prevented from entering from the lower side of the inking device 11.

Especially in the inking device 11-1 in the uppermost stage to the inking device 11-4 in the fourth stage, the foreign entry preventing structures formed by continuously juxtaposing the ink pans 14 and the fixed pans 19 (19-1 to 19-4) doubly and triply prevent foreign substances from entering the machine of the ink supply apparatus 1, in addition to the cover 77 of the doctor 71.

In the inking device 11-3 in the third stage and the inking device 11-4 in the fourth stage as well, the covers 83, the covers 77, the holding members 15, the ink pans 14, and the fixed pans 19-3 and 19-4 prevent foreign substances from entering the machine of the ink supply apparatus 1, as in the inking device 11-2 in the second stage.

As shown in FIG. 1, the inking device 11-1 in the uppermost stage includes a cover 84 for preventing foreign substances from entering the machine as the first cover in place of the cover 83. The cover 84 is disposed at a position above the ink fountain roller 30 and close to the injection nozzle 82 on the side of the ink fountain main body 12 and attached to the frames 51 and 52. The width of the cover 84 is almost equal to the width of the outer surface of the ink fountain roller 30.

The inking device 41 in the lowermost stage includes a cover 85 for preventing foreign substances from entering the machine as the first cover in place of the cover 83. The cover 85 is disposed above the ink fountain roller 30, the ink roller 33, and the injection nozzle 82 and attached to the frames 51 and 52. The width of the cover 85 is almost equal to the width of the outer surface of the ink fountain roller 30.

6. Arrangement for Controlling Cleaning Processing by Doctor

Figure 11:
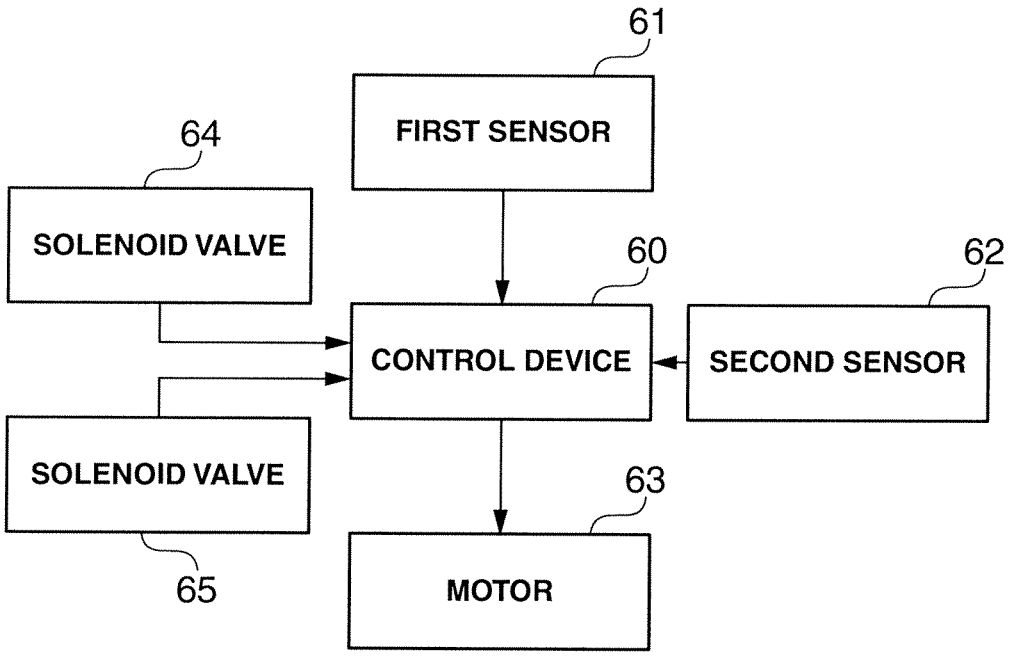
FIG. 11 is a block diagram showing the circuit arrangement of the ink supply apparatus.

As shown in FIG. 11, the inking device 11 further includes a control device 60, a first sensor 61, a second sensor 62, a motor 63, and the solenoid valves 64 and 65. The first sensor 61, the second sensor 62, the motor 63, and the solenoid valves 64 and 65 are electrically connected to the control device 60.

The first sensor 61 is a first detection device that detects the position of the ink fountain main body 12. The first sensor 61 is formed from a sensor such as a limit switch or a proximity switch that detects whether the ink fountain main body 12 is located at the first position upon printing. When the ink fountain main body 12 has left the first position, the first sensor 61 outputs the detection result to the control device 60.

The second sensor 62 is a second detection device that detects whether the doctor 71 is attached to the doctor holding member 70. The second sensor 62 is formed from a sensor such as a limit switch or a proximity switch that detects the presence or absence of attachment of the doctor 71 to the doctor holding member 70, and outputs the detection result to the control device 60.

The motor 63 is a driving device that rotates the ink fountain roller 30. The solenoid valve 64 is a cleaning fluid supply switching unit that turns on and off injection of the cleaning fluid from the injection nozzle 82. The solenoid valve 65 is a doctor blade abutting and separating switching unit that brings the doctor blade 74 of the doctor 71 into contact with the ink fountain roller 30 or separates the doctor blade 74 away from the ink fountain roller 30.

The control device 60 has a function of controlling the solenoid valves 64 and 65 based on the detection results of the first sensor 61 and the second sensor 62 to control the cleaning processing by the doctor 71. The control device 60 is formed from a CPU.

The first sensor 61, the second sensor 62, the motor 63, and the solenoid valves 64 and 65 are provided in each of the inking devices 11-1 to 11-4 and 41 in the uppermost to lowermost stages. One control device 60 controls the motors 63 and the solenoid valves 64 and 65 of the inking devices 11-1 to 11-4 and 41 based on the detection results of the sensors 61 and 62 of the inking devices 11-1 to 11-4 and 41. The control device 60 may be provided in each of the inking devices 11-1 to 11-4 and 41 and perform distributed processing.

7. Operation of Ink Supply Apparatus

<Printing Operation>

The operation of the ink supply apparatus 1 having the above-described arrangement will be described divisionally concerning the printing operation and the cleaning operation.

The storage spaces 13*a* of the ink fountain main bodies 12 of the five inking devices 11-1 to 11-4 and 41 store inks of different colors. When the ink fountain roller 30 rotates in the ink supply direction (counterclockwise in FIG. 1), the ink stored in the storage space 13*a* of the ink fountain main body 12 is adhered to the outer surface of the ink fountain roller 30 via the gap between the blade 16 for gap adjustment and the ink fountain roller 30 and extracted.

When the position of the blade 16 for gap adjustment is adjusted, the gap amount between the blade 16 for gap adjustment and the ink fountain roller 30 is adjusted, and the amount of ink extracted from the storage space 13*a* is adjusted.

The ink adhered to the ink fountain roller 30 is leveled by the ink roller 31 as the ink fountain roller 30 rotates. After that, the ink is transferred to the chevron cylinder 4 via the ink rollers 32 and 33 and supplied from the chevron cylinder 4 to the outer surface of the intaglio cylinder 8. The five color inks are thus supplied from the ink supply unit 2 to the five chevron cylinders 4 of the print processing unit 3, respectively.

An ink dropping from the distal end of the ink fountain main body 12 or the ink fountain roller 30 or the ink roller 31 during the printing operation is received by the ink pan 14 or the fixed pan 19. Hence, the ink is prevented from dropping the inking device on the lower side.

The fixed pan 19 is larger than the ink pan 14. The fixed pan 19 has a size large enough to wholly store the ink pan 14 placed on the fixed pan 19. The fixed pan 19 is stationarily arranged immediately under the ink pan 14. For this reason, even if the ink dropping from the distal end of the ink fountain main body 12 or the ink dropping from the ink fountain roller 30 or the ink roller 31 overflows from the ink pan 14, the ink that has overflowed is received by the fixed pan 19 that exists under the ink pan 14.

The printing operation in the inking devices 11-1 to 11-4 in the uppermost to fourth stages has been described above. The printing operation in the inking device 41 in the lowermost stage is almost the same. However, since the ink pan 14 and the holding member 15 are not attached to the ink fountain main body 12 of the inking device 41, the ink dropping from the distal end of the ink fountain main body 12 or the ink dropping from the ink fountain roller 30 or the ink roller 31 is received by the fixed pan 19-5.

<Cleaning Operation>

To clean the inking device 11 after the printing operation, the operator moves the ink fountain main body 12 to the second position shown in FIG. 3 and attaches the doctor 71 to the doctor holding member 70 in a state in which the print processing unit 3 is at rest, and the motor 63 for rotating the ink fountain roller 30 is at rest.

Before the cleaning operation, the piston rod 80*e* of the air cylinder 80 is extended in the direction of an arrow PS in FIG. 10. For this reason, the doctor blade 74 of the doctor 71 attached to the doctor holding member 70 is spaced apart from the outer surface of the ink fountain roller 30.

When the ink fountain main body 12 has moved to the second position, the first sensor 61 detects that the ink fountain main body 12 is not located at the first position upon printing. When the second sensor 62 detects that the doctor 71 is attached to the doctor holding member 70, the control device 60 controls the motor 63 and the solenoid valves 64 and 65 based on the detection results of the first sensor 61 and the second sensor 62, thereby cleaning the ink fountain roller 30 and the ink rollers 31 to 33.

More specifically, the control device 60 first drives the motor 63 to rotate the ink fountain roller 30 in the ink supply direction (the direction of an arrow in FIG. 10). Then, the control device 60 opens the solenoid valve 64 to inject the cleaning fluid from the injection nozzle 82 to the ink fountain roller 30 and the ink roller 33. The cleaning fluid is thus injected to the ink fountain roller 30 that is rotating.

When the cleaning fluid is supplied to the outer surface of the ink fountain roller 30, the control device 60 retracts the piston rod 80*e* of the air cylinder 80 in the direction of an arrow PL in FIG. 10 via the solenoid valve 65. The pivot shaft 81*a* thus pivots via the arm 81, and the doctor holding member 70 fixed to the pivot shaft 81*a* and the doctor 71 attached to the doctor holding member 70 pivot in a direction (the direction of an arrow RR in FIG. 10) to move close to the ink fountain roller 30. The doctor blade 74 of the doctor 71 is pressed against the outer surface of the ink fountain roller 30.

The ink on the ink fountain roller 30 dissolves in the cleaning fluid to generate a waste fluid which is scraped off by the doctor blade 74 and stored in the catch pan 71*a*. The ink and the cleaning fluid on the ink rollers 31 to 33 are scraped off by the doctor blade 74 via the ink fountain roller 30 and stored in the catch pan 71*a*. It is therefore possible to simultaneously clean the ink fountain roller 30 and the ink rollers 31 to 33.

During the cleaning, the operator can clean the ink fountain main body 12 and the like extracted to the second position. More specifically, the operator removes the ink adhered to the ink fountain main body 12, the blade 16 for gap adjustment, and the ink weirs 13 and wipes these members dry by wastes, thereby cleaning them.

In the cleaning operation, the ink fountain main body 12 is located at the second position shown in FIG. 3. For this reason, the ink or cleaning fluid dropping from the ink fountain roller 30 or the ink rollers 31 to 33 is received by the fixed pan 19. The ink or cleaning fluid dropping from the distal end of the ink fountain main body 12 located at the second position is received by the ink pan 14. Hence, the ink or cleaning fluid is prevented from dropping to the inking device on the lower side.

When the ink fountain main body 12 is located at the second position, the lower portion of the range for the distal end of the ink fountain main body 12 to the ink fountain roller 30 or the ink roller 31 is continuously covered by the ink pan 14 and the fixed pan 19. For this reason, the ink or cleaning fluid is properly prevented for dropping to the inking device 11 on the lower side.

When the cleaning operation has been done for a predetermined time, the control device 60 first closes the solenoid valve 64 to stop cleaning fluid injection from the injection nozzle 82. After the elapse of a predetermined time from the stop of cleaning fluid injection, the doctor blade 74 scrapes off the cleaning fluid on the outer surfaces of the ink fountain roller 30 and the ink rollers 31 to 33. At this timing, the control device 60 extends the piston rod 80*e* of the air cylinder 80 in the direction of the arrow PS in FIG. 10 via the solenoid valve 65. The pivot shaft 81*a* thus pivots via the arm 81, and the doctor holding member 70 fixed to the pivot shaft 81*a* and the doctor 71 attached to the doctor holding member 70 pivot in a direction (the direction of an arrow RL in FIG. 10) to move away from the ink fountain roller 30. The doctor blade 74 of the doctor 71 is separated from the outer surface of the ink fountain roller 30. After that, the control device 60 stops driving the motor 63 to stop the rotation of the ink fountain roller 30.

When the ink fountain roller 30 has stopped rotating, the operator detaches the doctor 71 from the doctor holding member 70, and the cleaning operation ends.

To clean the ink pan 14 during the cleaning or printing operation, the operator locates the lock lever 56 at the open position to open the opening 15*d*, grips the pan handles 14*a*, removes the ink pan 14 from the opening 15*d*, and cleans the ink pan 14 outside the printing press.

When the ink pan has been cleaned, the operator inserts the ink pan 14 from the opening 15*d* until the distal end 14*b* abuts against the inner wall 15*b* of the base plate 15*c* to place the ink pan 14 on the base plate 15*c*, and locates the lock lever 56 at the lock position. When the lock lever 56 is located at the lock position, the ink pan 14 is prevented from exiting from the opening 15*d*.

Even if the ink or cleaning fluid drops when the ink pan 14 is removed from then holding member 15, the dropping ink or cleaning fluid is received by the base plate 15*c* of the holding member 15. It is therefore possible to properly prevent the ink or cleaning fluid from dropping to the inking device 11 on the lower side.

As described above, the ink pan 14 can be removed and detached from the holding member 15 even during the cleaning operation or print processing. For this reason, the ink pan 14 can be cleaned while continuing cleaning the ink fountain main body 12 without stopping print processing. It is therefore possible to perform print processing without lowering the capacity utilization of the printing press.

The cleaning operation in the inking devices 11-1 to 11-4 in the uppermost to fourth stages has been described above. In the inking device 41 in the lowermost stage, the ink or cleaning fluid dropping from the ink fountain roller 30 or the ink rollers 31 to 33 is received by the fixed pan 19-5. The ink or cleaning fluid dropping from the distal end of the ink fountain main body 12 located at the second position is received by the fixed pan 44.

In the cleaning operation, the ink fountain main body 12 of an arbitrary one of the inking devices 11-1 to 11-4 and 41 in the uppermost to lowermost stages can be extracted and cleaned, or all ink fountain main bodies 12 can be extracted and cleaned.

To extract and clean all ink fountain main bodies 12, a state in which foreign substance entry into the machine of the ink supply apparatus 1 is properly prevented needs to be set. In a state in which all ink fountain main bodies 12 are extracted, and the doctors 71 are attached, as shown in FIG. 1, the covers 83 to 85, the covers 77 of the doctors 71, the ink pans 14, the holding members 15, and the fixed pans 19-1 to 19-5 and 44 prevent foreign substances from entering the machine inside from the ink fountain roller 30 and maintain the state to protect the structures in the machine. It is therefore possible to extract and clean all ink fountain main bodies 12.

8. Effects

According to the above-described arrangement, even when the ink fountain main bodies 12 of all the inking devices 11-1 to 11-4 and 41 are located at the second position upon non-printing, access into the machine is properly prevented. For this reason, the ink fountain rollers 30 of the inking devices 11-1 to 11-4 and 41 can be driven in the state in which all ink fountain main bodies 12 are located at the second position. It is therefore possible to simultaneously perform automatic cleaning of the ink fountain rollers 30 and the ink rollers 31 to 33 and cleaning of the ink fountain main bodies 12 by the operator. As a result, the cleaning time is shortened to improve the productivity, and the load on the operator is largely reduced.

The slide distance changes between the inking device 11-1 in the uppermost stage, the inking devices 11-2 to 11-4 in the second to fourth stages, and the inking device 41 in the lowermost stage. For this reason, the ink fountain main bodies 12 of the inking devices 11-1 to 11-4 and 41 in the respective stages can be arranged vertically almost in a straight line at the second position upon non-printing. This allows the operator to easily execute the cleaning operation of the ink fountain main bodies 12 in the respective stages.

When the ink fountain main bodies 12 of the inking devices 11-1 to 11-4 and 41 in the respective stages slidably move on the slide rails 11*a*, 11*b*, and 11*c* of the inking devices 11-1 to 11-4 and 41 in the respective stages, the ink fountain main bodies 12 can be located at positions where a sufficient space is ensured in the vertical direction. This allows the operator to efficiently clean the ink fountain main body 12 with minimum physical load.

The illuminations 12*b* are provided under the ink fountain main bodies 12 of the inking devices 11-1 to 11-4 in the uppermost to fourth stages. When the illuminations 12*b* illuminate the ink fountain main bodies 12 of on the lower side and vicinities thereof, the ink fountain main body 12 on the lower side can be cleaned under a bright environment.

As described above, according to the above-described embodiment, when the ink fountain main body 12 is located at the second position, the doctor 71 configured to clean the ink fountain roller 30 can be set in the space between the ink fountain main body 12 and the ink fountain roller 30 while bringing the doctor blade 74 and the ink fountain roller 30 into contact with each other. It is therefore possible to effectively use the space between the ink fountain main body 12 and the ink fountain roller 30, which is formed when the ink fountain main body 12 is extracted from the first position to the second position. It is also possible to efficiently clean the ink fountain roller 30 without physical load on the operator.

In addition, since the ink fountain main body 12 can be extracted from the far side in the machine to the near side by sliding the ink fountain main body 12 from the first position to the second position, the ink fountain main body 12 can be cleaned without physical load on the operator.

9. Other Embodiments

In the above-described embodiment, a case has been described in which the cleaning fluid used for cleaning by the doctor blade 74 is received by the catch pan 71*a* integrated with the doctor blade 74. However, the catch pan 71*a* need not always be integrated with the doctor blade 74. The cleaning fluid may be received by the catch pan 71*a* provided independently of the doctor blade 74. In this case, the doctor blade abutting and separating unit may be configured to bring only the doctor blade 74 into contact with the ink fountain roller 30 or separate them from each other.

In the above-described embodiment, a sensor such as a limit switch or a proximity switch is usable as the first sensor 61. However, the present invention is not limited to this. A device that optically detects the position using a photodetector or the like or a device that detects the position of the ink fountain main body 12 on the slide rails 11*b*, like a potentiometer, is also usable.

In the above-described embodiment, the first sensor 61 detects that the ink fountain main body 12 is located at the first position. However, the present invention is not limited to this. The first sensor 61 may be a sensor for detecting that the ink fountain main body 12 is located at the second position. In this case, when the first sensor 61 detects that the ink fountain main body 12 is located at the second position, and the second sensor 62 detects that the doctor 71 is attached to the doctor holding member 70, the control device 60 controls to start the cleaning operation for the outer surface of the ink fountain roller 30.

In the above-described embodiment, a sensor such as a limit switch or a proximity switch is usable as the second sensor 62. However, the present invention is not limited to this. A device that optically detects the position using a photodetetor or the like is also usable as the second sensor 62.

In the above-described embodiment, the inking devices 11-1 to 11-4 and 41 are applied to the intaglio printing press. However, the present invention is not limited to this. The inking devices 11-1 to 11-4 and 41 are applicable to printing presses of various other types.

What is claimed is:

1. An ink supply apparatus of a printing press, comprising at least one inking device including:

an ink fountain roller that is rotatably supported;

an ink fountain main body that forms a space to store an ink together with an outer surface of the ink fountain roller;

a guide member that slidably supports the ink fountain main body and guides the ink fountain main body between a first position where the space is formed and a second position spaced apart from the ink fountain roller than the first position; and a doctor holding member to which a doctor including a blade is attached between the ink fountain main body and the ink fountain roller only when the ink fountain main body is located at the second position, the blade abutting against the ink fountain roller and cleaning the ink fountain roller.

2. An apparatus according to claim 1, wherein the at least one inking device further includes:

a first cover that is provided above the ink fountain roller, covers a space above the ink fountain roller, and prevents foreign substances from entering the ink supply apparatus; and a second cover that is provided under the doctor, covers a space under the doctor, and prevents the foreign substances from entering the ink supply apparatus.

3. An apparatus according to claim 1, further comprising a plurality of inking devices arranged to line up vertically as the at least one inking device.

4. An apparatus according to claim 3, wherein each of the plurality of inking devices except an inking device in a lowermost stage further includes an illumination that illuminates the ink fountain main body of the inking device in a stage under the inking device.

5. An ink supply apparatus of a printing press comprising at least one inking device including:

an ink fountain roller that is rotatably supported;

an ink fountain main body that forms a space to store an ink together with an outer surface of the ink fountain roller;

a guide member that slidably supports the ink fountain main body and guides the ink fountain main body between a first position where the space is formed and a second position spaced apart from the ink fountain roller than the first position; and a doctor holding member to which a doctor including a blade is attached between the ink fountain main body and the ink fountain roller when the ink fountain main body is located at the second position, the blade abutting against the ink fountain roller and cleaning the ink fountain roller, wherein the at least one inking device further includes:

a first cover that is provided above the ink fountain roller, covers a space above the ink fountain roller, and prevents foreign substances from entering the ink supply apparatus; and a second cover that is provided under a pace under the doctor, covers a space under the doctor, and prevents the foreign substances from entering the ink supply apparatus, wherein the at least one inking device further includes an ink pan that is supported under the ink fountain main body to move integrally with the ink fountain main body, receives an ink dropping from the ink fountain main body, and prevents the foreign substances from entering the ink supply apparatus when the ink fountain main body is located at the second position.

6. An apparatus according to claim 5, wherein the at least one inking device further includes a fixed pan that is stationarily arranged under the ink fountain roller, receives the ink dropping from the ink fountain main body, covers a space under the ink fountain main body and the ink fountain roller together with the ink pan when the ink fountain main body is located at the second position, and prevents the foreign substances from entering the ink supply apparatus.

7. An apparatus according to claim 6, wherein the at least one inking device further includes:

a first detection device that detects a position of the ink fountain main body;

a second detection device that detects whether the doctor is attached to the doctor holding member; and a driving device that rotates the ink fountain roller, and the ink supply apparatus further comprises a control device that is connected to the first detection device, the second detection device, and the driving device and controls the driving device based on a detection result of each of the first detection device and the second detection device.

8. An apparatus according to claim 7, wherein the control device is adapted to control the driving device to rotate the ink fountain roller when the first detection device has detected that the ink fountain main body is not located at the first position and the second detection device has detected that the doctor is attached to the doctor holding member.

9. An apparatus according to claim 6, wherein the at least one inking device comprises a plurality of inking devices arranged to line up vertically, wherein in each of stages of the plurality of inking devices except an uppermost stage, the first cover covers a space between the ink fountain roller and one of the ink pan and the fixed pan of an inking device in a stage immediately above, thereby preventing the foreign substances from entering the ink supply apparatus.

10. An ink supply apparatus of a printing press, comprising at least one inking device including:

an ink fountain roller that is rotatably supported;

an ink fountain main body that forms a space to store an ink together with an outer surface of the ink fountain roller;

a guide member that slidably supports the ink fountain main body and guides the ink fountain main body between a first position where the space is formed and a second position spaced apart from the ink fountain roller than the first position; and a doctor holding member to which a doctor including a blade is attached between the ink fountain main body and the ink fountain roller when the ink fountain main body is located at the second position, the blade abutting against the ink fountain roller and cleaning the ink fountain roller, wherein the at least one inking device further includes an ink pan that is supported under the ink fountain main body to move integrally with the ink fountain main body and receives an ink dropping from the ink fountain main body.

11. An apparatus according to claim 10, wherein the ink fountain main body includes an ink pan holding member to which the ink pan is detachably attached.

12. An apparatus according to claim 11, wherein the ink pan holding member includes a base plate on which the ink pan is placed when the ink pan is attached, and which receives the ink dropping from the ink fountain main body when the ink pan is detached.

13. An apparatus according to claim 12, wherein the ink pan holding member further includes:

a stopper against which a distal end of the ink pan abuts; and a regulating member that regulates a movement of a rear end of the ink pan.

14. An apparatus according to claim 10, wherein the ink pan is arranged under a distal end of the ink fountain main body on a side of the ink fountain roller.

15. An apparatus according to claim 14, wherein the at least one inking device further includes a fixed pan that is stationarily arranged under the ink fountain roller and receives the ink dropping from the ink fountain main body, and when the ink fountain main body is located at the first position, the ink pan is located above the fixed pan.

16. An apparatus according to claim 14, wherein the at least one inking device further includes an ink roller that contacts the ink fountain roller under the ink fountain roller, and when the ink fountain main body is located at the first position, the ink pan receives the ink dropping from the ink fountain main body and the ink roller.

* * * * *

UNITED STATES PATENT AND TRADEMARK OFFICE

CERTIFICATE OF CORRECTION

PATENT NO. : 8,939,078 B2
APPLICATION NO. : 13/571322
DATED : January 27, 2015
INVENTOR(S) : Hiroyoshi Kamoda et al.

It is certified that error appears in the above-identified patent and that said Letters Patent is hereby corrected as shown below:

In the Claims,

Column 14, Claim 5, line 49, please delete “under a pace”.

Signed and Sealed this
Twenty-ninth Day of September, 2015

Michelle K. Lee

Michelle K. Lee
*Director of the United States Patent and Trademark Office*